United States Patent [19]

Wilson

[11] Patent Number: 4,987,929

[45] Date of Patent: Jan. 29, 1991

[54] FORMING FABRIC WITH INTERPOSING CROSS MACHINE DIRECTION YARNS

[75] Inventor: Robert G. Wilson, Wake Forest, N.C.

[73] Assignee: Huyck Corporation, Wake Forest, N.C.

[21] Appl. No.: 398,408

[22] Filed: Aug. 25, 1989

[51] Int. Cl.[5] ..... D03D 13/00; D03D 15/00

[52] U.S. Cl. ..... 139/383 A

[58] Field of Search ..... 139/383 A, 425 A, 413

[56] References Cited

U.S. PATENT DOCUMENTS

| | | | |
|---|---|---|---|
| 3,885,602 | 5/1975 | Slaughter | 139/425 A |
| 4,041,989 | 8/1977 | Johansson et al. | 139/413 X |
| 4,239,065 | 12/1980 | Trokhan | 139/383 A |
| 4,423,755 | 1/1984 | Thompson | 139/383 A |
| 4,499,927 | 2/1985 | Borel | 139/413 X |
| 4,554,953 | 11/1985 | Borel et al. | 139/425 A X |
| 4,592,396 | 6/1986 | Borel et al. | 139/413 X |
| 4,709,732 | 12/1987 | Kinnunen | 139/383 A |

*Primary Examiner*—Andrew M. Falik

*Attorney, Agent, or Firm*—Lorusso & Loud

[57] ABSTRACT

A papermakers' fabric, especially a forming fabric, with very high fiber support and open area on its top surface to enhance the papermaking characteristics. The papermaking surface consists of a woven fabric layer with single float machine direction yarn knuckles; i.e., no machine direction yarn passes over two or more adjacent top surface cross machine direction yarns. To complete the papermaking surface, into this base structure is woven two additional, generally smaller diameter, cross machine direction yarns for every cross machine direction yarn in the base weave papermaking surface. These two additional cross machine direction yarn pairs are woven in reverse weave patterns to one another such that natural interposing forces cause the two yarns to align one over the other centrally between two adjacent cross machine direction yarns of the fabric layer. One yarn of the interposing pair functions as an additional fiber supporting yarn while the other yarn acts as a locator yarn to position the fiber supporting yarn in the proper or ideal location on the papermaking surface.

13 Claims, 8 Drawing Sheets

FORMING FABRIC WITH INTERPOSING CROSS MACHINE DIRECTION YARNS

BACKGROUND OF THE INVENTION

This invention relates to woven papermakers' fabrics and especially to forming fabrics, including those known as fourdrinier wires.

In the conventional fourdrinier papermaking process, a water slurry or suspension of cellulosic fibers, known as the paper "stock" is fed onto the top of the upper run of a traveling endless belt of woven wire and/or synthetic material. The belt provides a papermaking surface and operates as a filter to separate the cellulosic fibers from the aqueous medium to form a wet paper web. In forming the paper web, the forming belt serves as a filter element to separate the aqueous medium from the cellulosic fibers by providing for the drainage of the aqueous medium through its mesh openings, also known as drainage holes, by vacuum means or the like located on the machine side of the fabric. After leaving the forming section, the paper web is transferred to the press section of the machine, where it is passed through a series of pressure nips formed by cooperating press rolls to remove still more of its moisture content and finally to the dryer section for further moisture removal.

Such papermakers' fabrics are manufactured in two basic ways to form an endless belt. First, they can be flat woven by a flat weaving process with their ends joined by any one of a number of well known methods to form the endless belt. Alternatively, they can be woven directly in the form of a continuous belt by means of an endless weaving process. In a flat woven papermakers' fabric, the warp yarns extend in the machine direction and the filling yarns extend in the cross machine direction. In a papermakers' fabric having been woven in an endless fashion, the warp yarns extend in the cross machine direction and the filling yarns extend in the machine direction. As used herein the terms "machine direction" and "cross machine direction" refer respectively to a direction equivalent to the direction of travel of the papermakers' fabric on the papermaking machine and a direction transverse to this direction of travel. Both methods are well known in the art and the term "endless belt" as used herein refers to belts made by either method.

Effective sheet support and lack of wire marking are important considerations in papermaking, especially for the forming section of the papermaking machine where the wet web is formed. The problem of wire making is particularly acute in the formation of fine paper grades where the smoothness of the sheet side surface of the forming fabric is critical as it affects paper properties such as sheet mark, porosity, see through, pin holing and the like. Accordingly, paper grades intended for use in carbonizing, cigarettes, electrical condensers, quality printing and like grades of fine paper have heretofore been formed on very fine woven forming fabrics or fine wire mesh forming fabrics. In order to ensure the good paper quality required, the side of the papermakers' fabric which contacts the paper stock should provide high support for the stock, preferably in the cross machine direction because paper fibers delivered from the headbox to the forming fabric are generally aligned in the machine direction more so than they are in the cross machine direction. Trapping these paper fibers on the top of the forming fabric during the drainage process is more effectively accomplished by providing a permeable structure with a co-planar or bicrimped surface which allows paper fibers to bridge the support grid of the fabric rather than align with the support grid.

Such forming fabrics, however, may often be delicate and lack stability in the machine and cross machine directions, leading to a short service life. Abrasive and adhesive wear caused by contact with the papermaking machine equipment is a real problem. The side of the papermakers' fabric which contacts the paper machine equipment must be tough and durable. These qualities, however, most often are not compatible with the good drainage and fiber supporting characteristics desired for the sheet side of a papermakers' fabric.

In order to meet both standards, two layers of fabric can be woven at once by utilizing threads of different size and/or count per inch and another thread to bind them together. This fabric is commonly called a double layer fabric. Alternatively, fabrics have been created using multiple warps so that the fabric would have the desirable papermaking qualities on the surface that faces the paper web and desirable wear resistance properties on the machine contacting surface For example, papermakers' fabrics may be produced from two separate fabrics, one having the qualities desired for the paper contacting side and the other with the qualities desired the machine contacting side and then the two fabrics are joined together by a third set of threads. This type fabric is commonly called a triple-layer fabric. Generally, these structures do not possess the high level of stretch resistance desired in a papermaking fabric. Furthermore, the yarn that binds the fabric together will often produce a sheet mark, often from the long machine direction floats. Accordingly, no known fabrics have achieved the qualities necessary to meet those competing standards to produce superior paper.

SUMMARY OF THE INVENTION

In accordance with the present invention, there is provided an improved papermakers' fabric and a method of making the same for use in a papermaking machine, including an initial fabric layer having single float machine direction knuckles on the paper contacting surface and into which are woven additional fiber supporting cross machine direction yarns, preferably of smaller diameter than the fabric layer yarns. The additional fiber supporting cross machine direction yarns are held in place centrally between adjacent fabric layer cross machine direction yarns by additional cross machine direction locator yarns, generally being of approximately the same smaller diameter as the fiber supporting yarns. The papermakers' fabric of the present invention may be a single-layer, double-layer or triple-layer fabric.

These and other objects of the present invention will be obvious from the following detailed description of the invention, taken together with the drawing in which like reference numbers refer to like members throughout the various figures.

DETAILED DESCRIPTION OF THE PRESENT INVENTION

Figure 1:
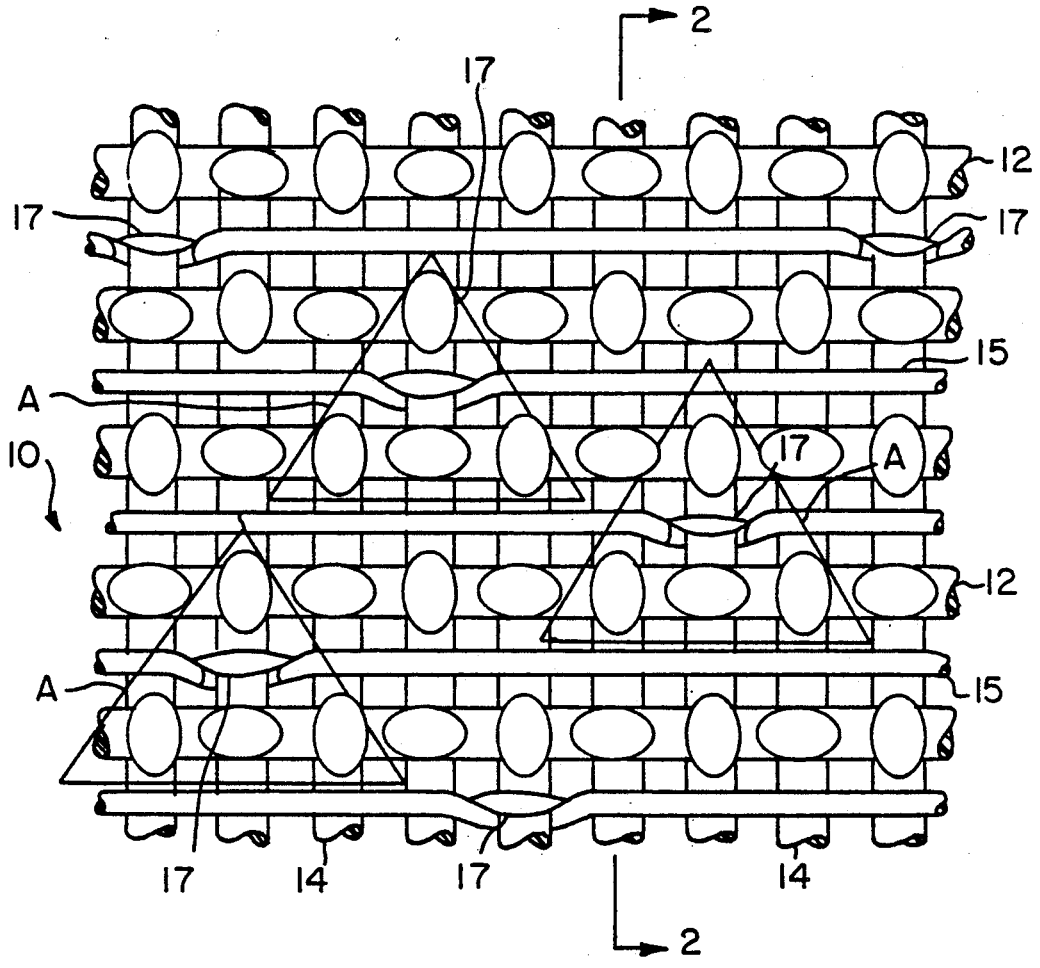
FIG. 1 illustrates the sheet side of one embodiment of the papermakers' fabric of the present invention.

The fabric of the present invention will be described broadly, with a more detailed description following. This papermakers' fabric provides a superior papermaking surface and is especially suitable for the forming section of a papermaking machine. The fabric of the present invention is characterized by the presence of two additional yarns in the cross machine direction.

The fabric of the present invention is a papermakers' fabric with a particular weave. For ease of understanding the concepts of the invention, the fabric will be described as if a fabric layer was initially woven and then additional yarns added. Of course, the papermakers' fabric made according to the present invention will be woven in a one step weaving process, as is commonly done.

The yarns utilized in the fabric of the present invention will vary, depending upon the desired properties of the final papermakers' fabric. For example, the yarns may be multifilament yarns, monofilament yarns, twisted multifilament or monofilament yarns, spun yarns or any combination of the above. It is within the skill of those practicing in the relevant art to select a yarn type, depending on the purpose of the desired fabric, to utilize with the concepts of the present invention.

Yarns selected for use in the fabric of the present invention may be those commonly used in papermakers' fabric. The yarns could be cotton, wool, polypropylenes, polyesters, aramids or nylon. Again, one skilled in the relevant art will select a yarn material according to the particular application of the final fabric. A commonly used yarn which can be used to great advantage in weaving fabrics in accordance with the present invention is a polyester monofilament yarn, sold by Hoechst Celanese Fiber Industries under the trademark "Trevira".

Initially, there is provided a fabric layer structure. This layer may be a single layer fabric or a multiple layer fabric. The layer must, however, have on its paper contacting surface single float machine direction knuckles. By single float machine direction knuckles is meant that no machine direction yarn ever passes over more than one consecutive cross machine direction yarn before passing back down into the center or bottom of the fabric layer. Instead of long machine direction yarn floats on the paper contacting surface of the fabric layer, knuckles are provided. In addition, the base structure fabric is provided with a series of alternating machine direction knuckles on two adjacent cross machine direction yarns of the fabric layer.

Interwoven with the fabric layer structure on its papermaking surface are two sets of additional cross machine direction yarns, additional fiber supporting cross machine direction yarns and additional cross machine direction locator yarns. In a preferred embodiment of this fabric, these additional cross machine direction yarns are of a smaller diameter than the yarns making up the base structure fabric. The size of the smaller diameter additional fiber supporting yarn, and hence the locator yarns as well, is governed by the size and spacing of the papermaking surface cross machine direction yarns of the base fabric. Generally the diameter of the smaller yarns is one half the diameter of the initial fabric layer cross machine direction yarn. Suitable yarn widths for the yarns of the base fabric structure and the corresponding fiber supporting and locator yarns are shown in the following table:

TABLE

| Papermaking surface cross machine direction yarns | | Fiber supporting and locator cross machine direction yarns |
|---|---|---|
| Number/Inch | Dia., mm | Dia., mm |
| 50 | .22 | .104 |
| 45 | .22 | .105 |
| 40 | .22 | .106 |
| 35 | .22 | .107 |
| 30 | .22 | .108 |
| 40 | .23 | .101 |
| 40 | .24 | .115 |
| 40 | .25 | .120 |
| 40 | .26 | .124 |

These yarns are located generally between parallel cross machine direction yarns of the paper contacting surface of the initial fabric layer and are woven into this surface. These two additional cross machine direction yarn pairs are woven in reverse generally weave patterns to one another such that natural interposing forces cause the two yarns to align one over the other centrally between two adjacent initial fabric layer cross machine direction yarns. One yarn of the interposing pair functions as an additional fiber supporting yarn while the other yarn acts as a locator yarn to position the fiber supporting yarn in the proper or ideal location on the papermaking surface.

Initially, additional fiber supporting cross machine direction yarns are interwoven with the papermaking surface of the initial fabric layer. These additional fiber supporting yarns, which in a preferred embodiment are of a smaller diameter than the yarns making up the layer, are woven into this surface by passing under one machine direction yarn only and over a multiple number of adjacent machine direction yarns.

Then, additional cross machine direction locator yarns are woven into the paper contacting surface of the fabric layer. As noted above, these additional locator yarns will generally be of the same diameter as the additional fiber supporting yarns. They are also woven into the paper contacting surface of the fabric layer immediately adjacent to those fiber supporting yarns in a weave pattern generally opposite to that of the fiber supporting yarns creating end points. The end points of the additional fiber supporting yarn and the locator yarn is defined as the point where these two yarns interchange positions from the top of the fabric. The present invention requires that these end points where the fiber supporting yarn and the locator yarn must have an equal pattern of machine direction yarn knuckles to cause the pair of yarns (fiber support and locator) to locate centrally between adjacent base weave cross machine direction yarns.

It should be noted that the series of alternating machine direction knuckles on the two adjacent cross machine direction yarns of the fabric layer act as lifter points for the additional fiber supporting yarns. Furthermore, the additional locator yarns act to centrally locate the additional fiber supporting yarn between the two adjacent base weave cross machine direction yarns. Since the forces on the locator yarn are equal and opposite in direction to those acting on the fiber supporting yarns, these generally smaller yarns will stack one over the other. These effects can be noted from the figures, described below.

Figure 2:
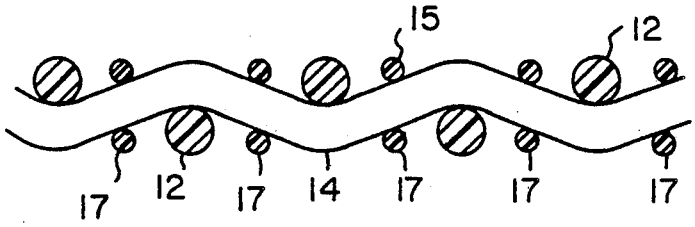
FIG. 2 is a cross-sectional view of the fabric of FIG. 1, taken along the line 2—2 in FIG. 1.

FIGS. 1 and 2 illustrate one embodiment of the fabric of the present invention. The initial fabric layer 10 is a single layer fabric including a layer of cross machine direction yarns 12 interwoven with machine direction yarns 14. On the papermaking surface as shown in FIG. 1, the fabric 10 is woven with single float machine direction yarn 14 knuckles, alternating on two adjacent base weave cross machine direction yarns 12. By "alternating" is meant that if a machine direction knuckle is formed on one cross machine direction yarn 12, no machine direction knuckle will form on the adjacent cross machine direction yarns 12 and the machine direction yarn 14 will pass under those cross machine direction yarn 12. The additional cross machine direction fiber supporting yarns 15 are positioned between the fabric layer cross machine direction yarns 12 and interwoven with the initial fabric weave structure 10 by passing under one machine direction yarn 14 and over the next seven machine direction yarns 14. The additional cross machine direction locator yarn 17 is interwoven with the fabric layer 10 so that it has a weave pattern generally opposite to that of the fiber supporting yarns 15 and appears on the paper contacting surface only at that point where the additional fiber supporting yarns 15 travel under the machine direction yarn 14. FIG. 2 illustrates the view taken along the lines 2—2 in FIG. 1.

A characterizing feature of the present invention can be seen in FIG. 1. On the paper contacting surface of a fabric formed according to the present invention, the machine direction knuckles define repeating triangles, having the end point as described above forming the center of each triangle, on the machine direction yarns 12 of the fabric layer 10 adjacent the additional fiber supporting yarn 15 and the locator yarn 17. This phenomenon is illustrated at Points A in FIG. 1.

Figure 3:
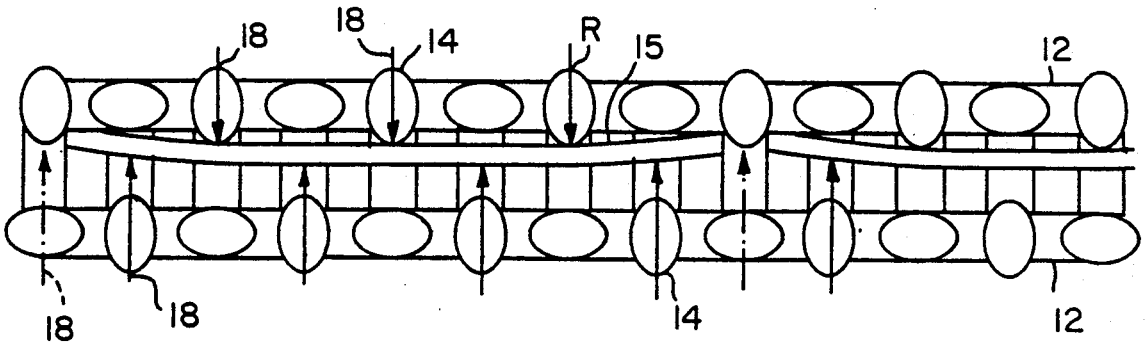
FIG. 3 illustrates the sheet side of the embodiment of the present invention shown in FIG. 1 when no locator yarn is used to properly position the additional fiber supporting yarn.

FIG. 3 illustrates the forces present on the additional fiber supporting cross machine direction yarns 15 prior to the introduction of the additional cross machine direction locator yarns 17. The arrows represent the forces pulling on the fiber supporting yarns 15. The effect of such forces are explained in greater detail below.

Figure 4:
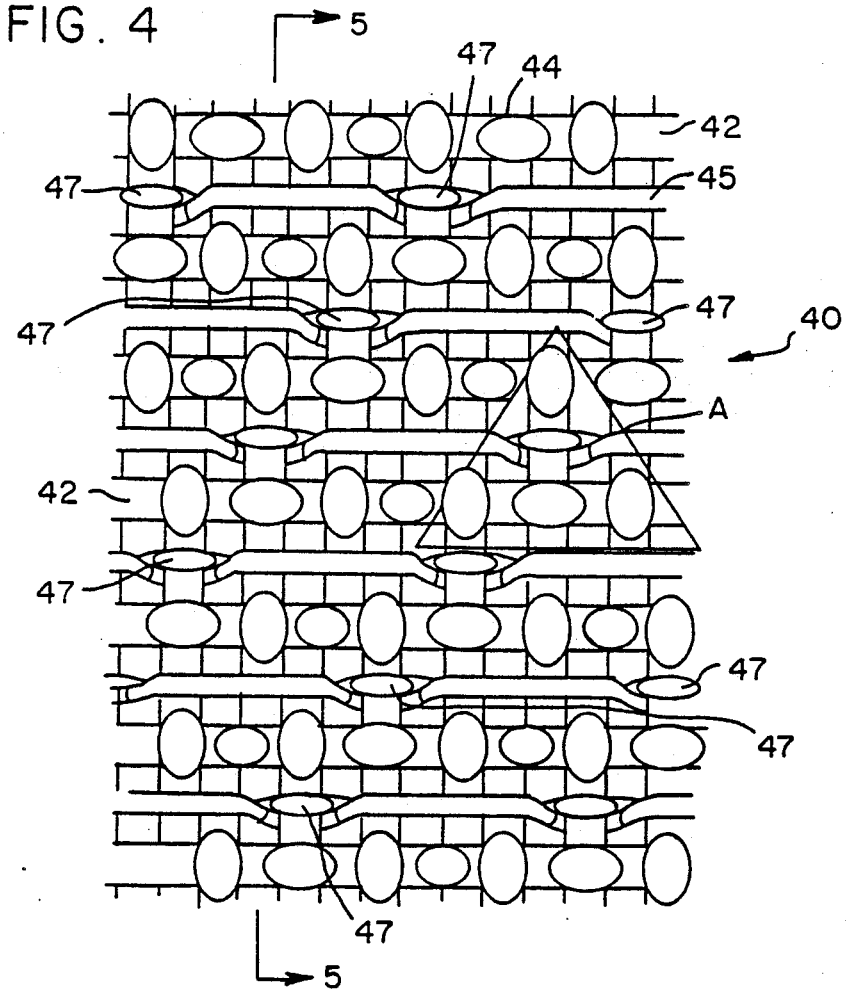
FIG. 4 illustrates the sheet side of another embodiment of the fabric of the present invention.
Figure 5:
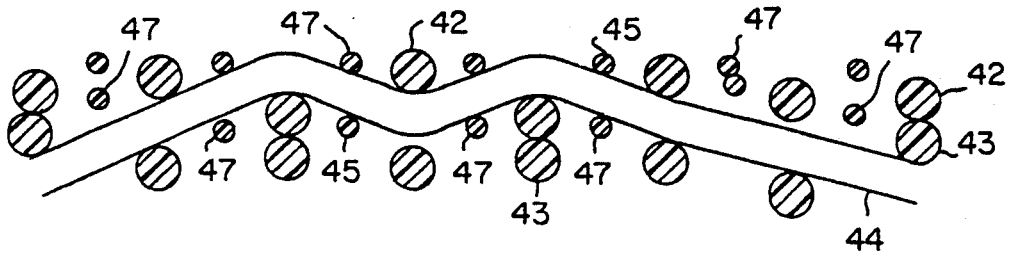
FIG. 5 is a cross-sectional view of the embodiment of FIG. 4, showing the path of the machine direction yarn relative to the various cross machine direction yarns of the fabric.

FIGS. 4 and 5 illustrate another embodiment of the fabric of the present invention, utilizing a seven harness dual layer construction for the initial fabric layer 40. The dual layer fabric construction 40 includes a layer of paper contacting cross machine direction yarns 42 and, located substantially below and parallel thereto, a layer of machine contacting cross machine direction yarns 43. These yarns 42 and 43 are interwoven with a set of machine direction yarn 44 in such a manner that the paper contacting surface of the fabric 40 (shown in FIG. 4) has single float machine direction knuckles, alternating on two adjacent paper contacting cross machine direction yarns 42 of the fabric layer. Interwoven with the paper contacting surface of the fabric layer 40, the additional fiber supporting cross machine direction yarns 45 travel over six machine direction yarns 44 on the paper contacting surface of the fabric prior to passing under one machine direction yarn 44. Additional cross machine direction locator yarns 47 are also interwoven with the paper contacting surface of the fabric layer 40 in a weave pattern generally opposite to that of the additional fiber supporting cross machine direction yarns 45. Again, at that point of interweaving, the end point, the locator yarn 47 will appear at the paper contacting surface and the fiber supporting yarn 45 will travel below the paper contacting surface of the fabric. One point at which the characterizing feature of the present invention appears on the papermaking surface of the fabric is shown at Point A in FIG. 4.

Figure 6:
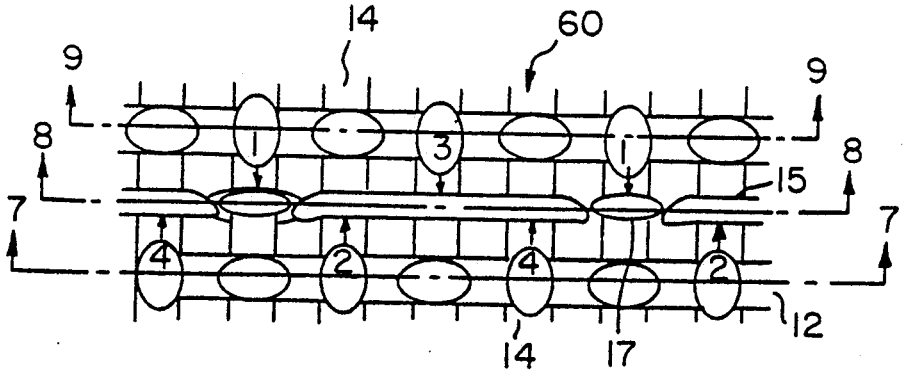
FIG. 6–9 are intended to further clarify the concept of the present invention, showing the geometric positioning of the initial fabric layer machine and cross machine direction yarns relative to the additional fiber supporting and locator cross machine direction yarns.
Figure 7:
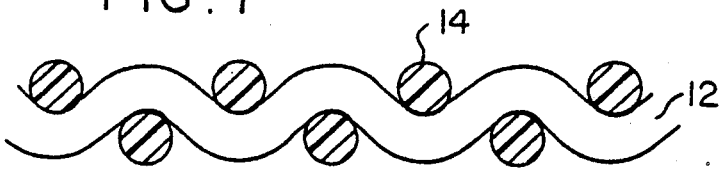
Figure 8:
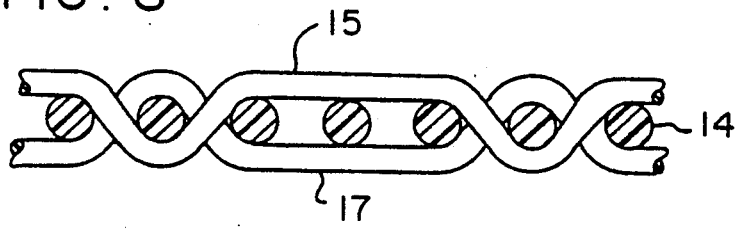
Figure 9:
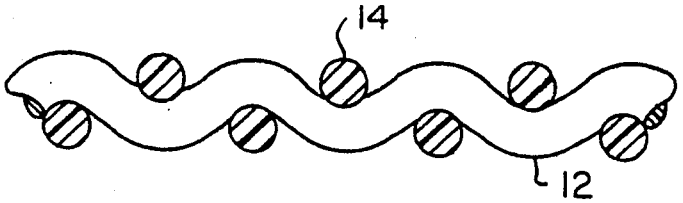

FIG. 6 shows a portion of the papermaking surface of a further embodiment of the present invention. In the fabric of this embodiment, a single fabric layer construction 60 is provided with additional fiber supporting cross machine direction yarns 15 and additional cross machine direction locator yarns 17 passing over three machine direction yarns 14 before passing under the one machine direction yarn 14. FIGS. 7-9 taken along lines 7—7, 8—8, and 9—9 respectively in FIG. 6 representing an exploded view of that portion of the surface, illustrate the geometric positioning of the fabric layer machine direction yarn 14 and cross machine direction yarns 12 relative to the additional fiber supporting 15 and locator 17 cross machine direction yarns.

Figure 10:
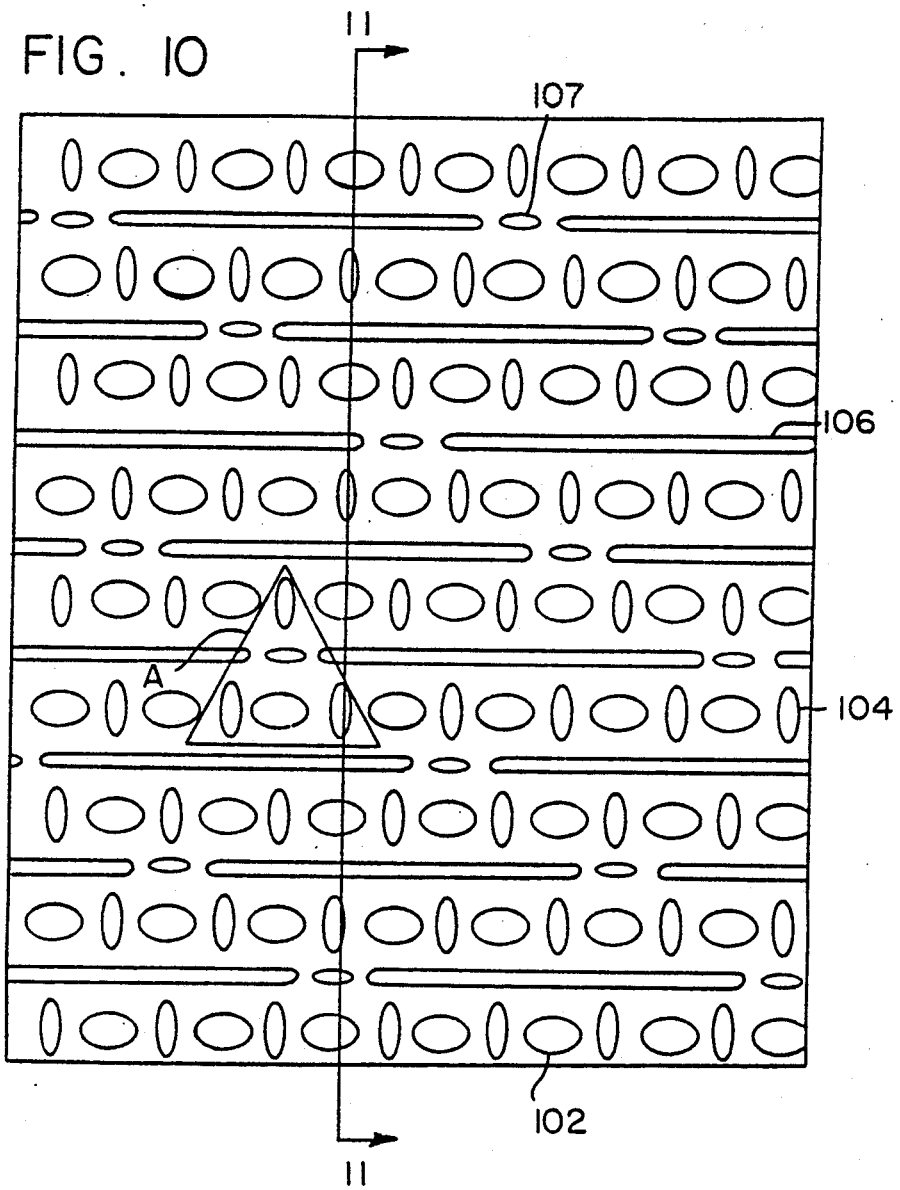
FIG. 10 is a view of the paper contacting surface of a further embodiment of the present invention.
Figure 11:
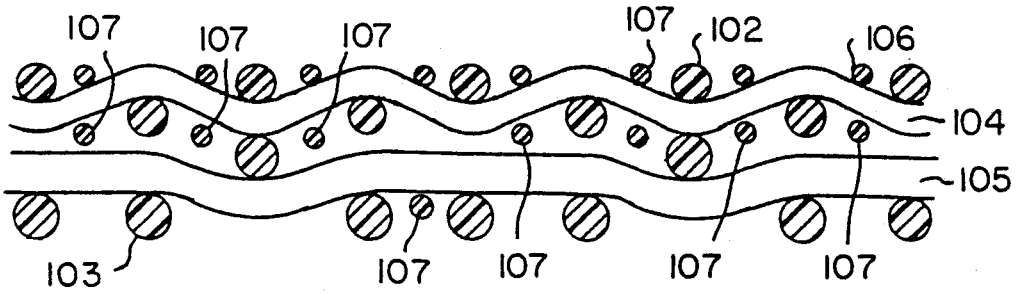
FIG. 11 is a cross sectional view of the fabric in FIG. 10, taken along the line 11—11 in FIG. 10.

FIGS. 10 and 11 illustrate yet another embodiment of the present invention, with a triple layer fabric construction. The fabric layer incorporates paper contacting cross machine yarns 102 and machine contacting cross machine direction yarns 103 substantially parallel and below. Interwoven therewith are paper contacting machine direction yarns 104 and machine contacting machine direction yarns 105 so that the paper contacting surface of the fabric shown has single float machine direction knuckles alternating on two adjacent paper contacting cross machine direction yarns 104. Additional fiber supporting cross machine direction yarns 106 are interwoven with the paper contacting surface of the fabric layer to travel over seven machine direction yarns 104 prior to passing under one machine direction yarn. Cross machine direction locator yarns 107 are also interwoven with the paper contacting surface of the fabric layer in a weave pattern generally opposite to that of the additional fiber supporting cross machine direction yarns 106. In the triangle marked A formed by the single machine direction knuckles on the cross machine direction yarns which are adjacent to the additional fibers supporting cross machine direction yarn and the cross machine direction locator yarn, the end point where the locator yarn is on the paper contacting surface of the fabric and the additional fiber supporting yarn is below that surface is shown.

Figure 12:
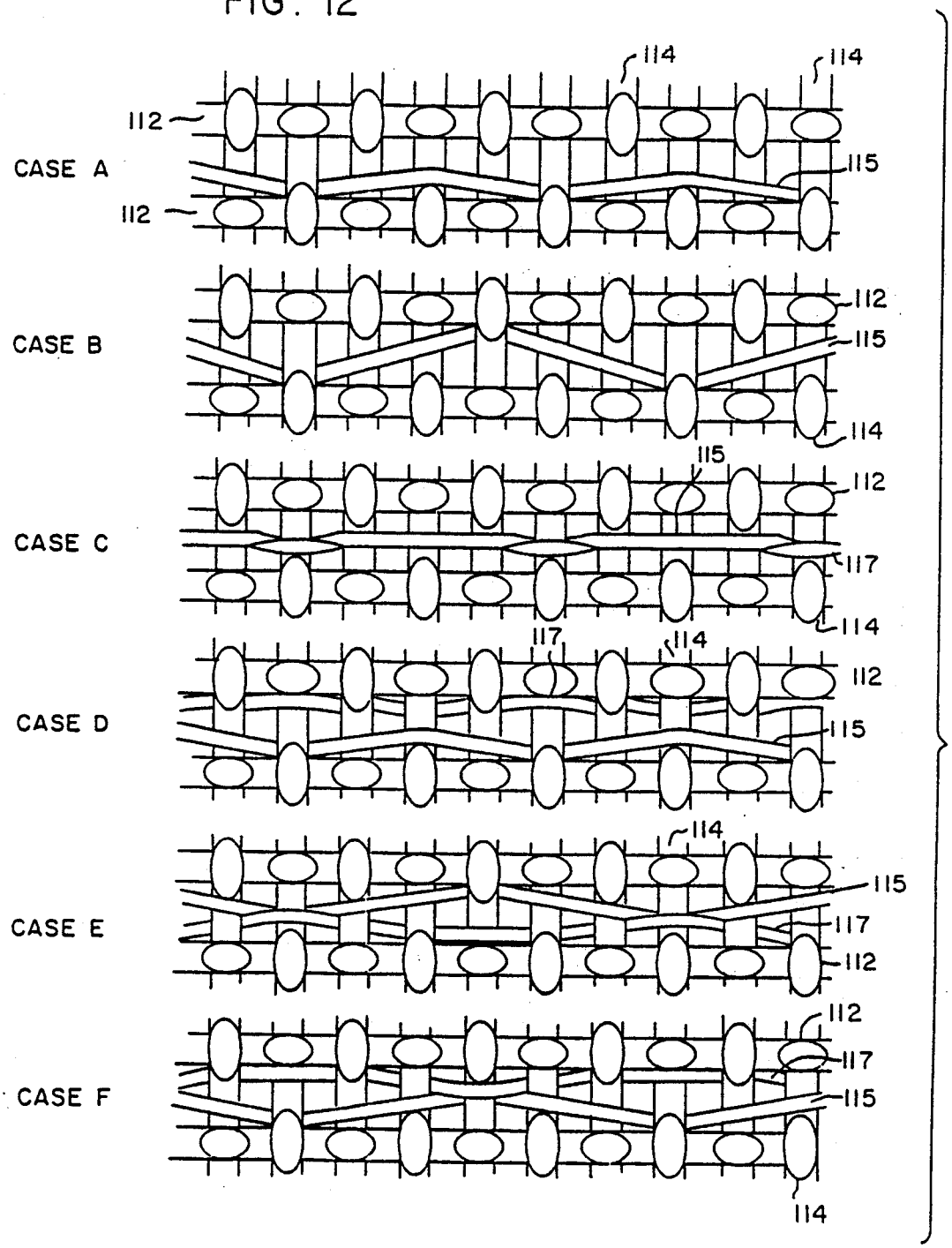
FIG. 12 shows various fabrics, to illustrate the effects of employing the concepts of the present invention.

A triple-layer fabric with a two-harness plain weave papermaking surface and a four-harness machine contacting surface weave presents an excellent construction for applying this new yarn positioning concept. As shown in FIG. 12, a smaller diameter fiber supporting cross machine direction yarn 115 is woven into the plain weave paper contacting surface of the initial fabric layer formed from interwoven machine direction 114 and cross machine direction yarns 112 by having it pass *under* one machine direction yarn 114 then *over* the next adjacent three machine direction yarns 114 of the papermaking surface. FIG. 12, case A, shows how this yarn would normally position itself in the plain weave fabric. As can be seen, the natural forces from the hills and valleys in the crimped machine direction yarns 114 would force the smaller yarn 115 to position itself in a non-central location between the two cross machine direction yarns 112 of the fabric layer. FIG. 12, case B, shows how the smaller yarn would position itself if it were to pass *under* one machine direction yarn 114 then *over* an even number (in this case two) of machine direction yarns 114. In this case, the smaller yarn is shoved at its end points in opposite directions causing the yarn 115 to pass in a diagonal path going across the fabric. Again, as in case A, the smaller yarn 115 is not centrally located between two cross machine direction yarns 112. FIG. 11, case C, shows how the additional fiber supporting yarn 115 is now ideally centrally positioned by incorporating the additional smaller diameter locator yarn 117. The natural forces from the hills and valleys of the crimped machine direction yarns 114 work on the two smaller diameter yarns 115, 117 with equal and opposite direction forces to centrally locate the additional fiber supporting yarn 115. Case D shows what would happen in the surface when the two small diameter yarns are improperly sequenced in the weaving process so that the two additional yarns do not act as an interposing pair to create the end point as defined in the present invention. Cases E and F show what would happen when an additional locator yarn 117 is used to try to centrally locate the fiber supporting yarn 115 as woven in case B. As can be seen, the locator yarn 117 is only able to move one end of the additional fiber supporting yarn 115. Case C is an example of the ideal application of the present invention.

Figure 13:
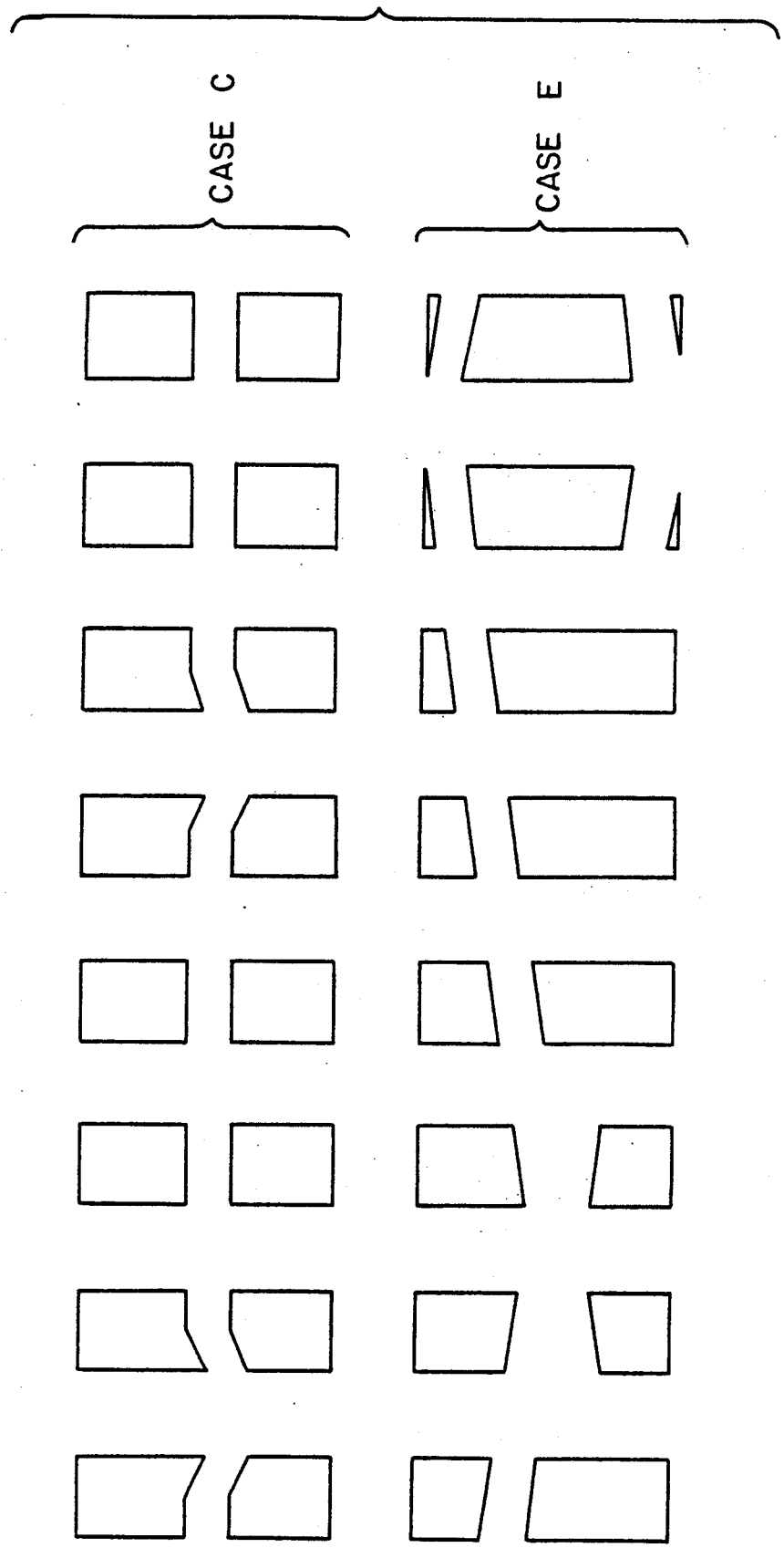
FIG. 13 is a schematic diagram of the drainage holes from two of the fabrics shown in FIG. 11.

FIG. 13 illustrates the resultant drainage holes on the papermaking surface of the fabrics shown in FIG. 11 cases C and E. The uniformity in drainage holes from case C are easily seen to be superior to those from case E.

Figure 14:
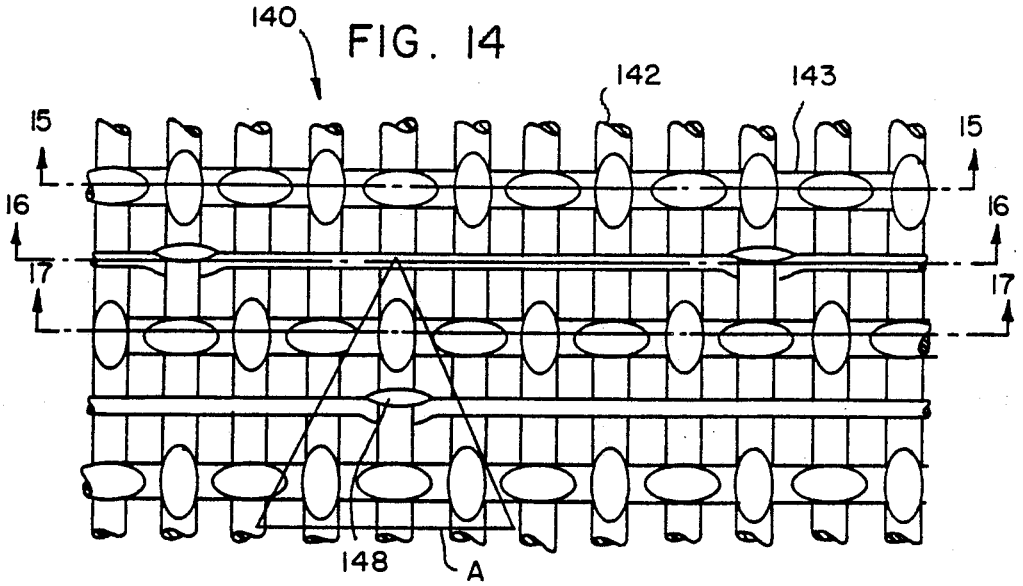
FIG. 14 shows the top surface of a triple layer fabric employing the concepts of the present invention.
Figure 15:
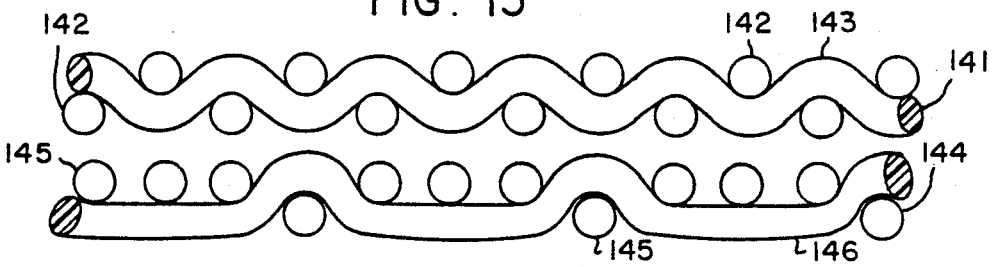
FIG. 15 illustrates a cross sectional view of the fabric in FIG. 14, taken along the line 15—15 in FIG. 14.
Figure 16:
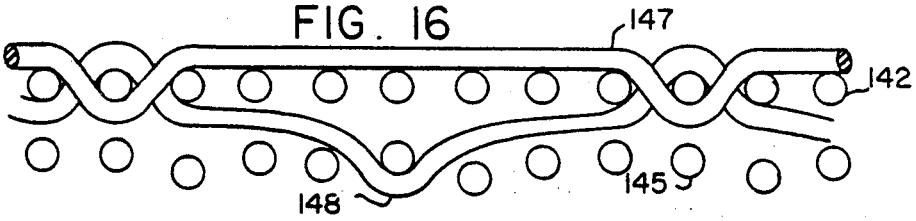
FIG 16 illustrates a cross sectional view of the fabric in FIG. 14, taken along the line 16—16 in FIG. 14.
Figure 17:
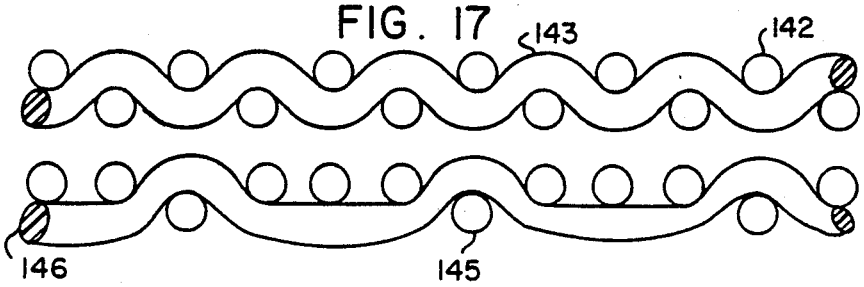
FIG. 17 illustrates a cross sectional view of the fabric in FIG. 14, taken along the line 17—17 in FIG. 14.

FIG. 14 shows a portion of the papermaking surface of the preferred embodiment of the present invention, which is a triple layer fabric 140. FIGS. 15, 16 and 17 are cross section views taken along the lines 15—15, 16—16 and 17—17 respectively in the surface view. FIGS. 15–17 illustrate cross sectional views of adjacent yarns traveling in the machine direction. The figures illustrate the geometric positioning of the machine direction 142 and cross machine direction 143 yarns of the single fabric layer 141 and the machine direction yarns 145 and cross machine direction yarns 146 of the single layer fabric 144 relative to the additional fiber supporting yarns 147 and locator cross machine direction yarns 148 which bind the fabrics together. In the fabric of this embodiment, a single layer fabric 141 incorporating machine direction 142 and cross machine direction 143 yarns interwoven to form single float machine direction knuckles alternating on two adjacent cross machine direction yarns is selected for the paper contacting surface of the completed papermaking fabric 140. This upper fabric 141 is a 1×1 weave. Directly below that fabric, and representing the machine contacting surface of the papermakers' fabric 140 is a single layer fabric 144 incorporating machine direction 145 and cross machine direction 146 yarns woven in a 1×3 weave. The two fabrics are joined to form a triple layer papermakers' fabric 140 by two additional sets of cross machine direction yarns, additional fiber supporting yarns 147 and locator yarns 148 which also act as the binder yarn holding the two fabrics together. The fiber supporting yarns 147 travel over seven machine direction yarns 142 on the paper contacting surface and under one machine direction yarn 142. The locator and binder yarn 148, woven into the fabric 140 in a pattern opposite to that of the fiber supporting yarn 147, travels under the seven machine direction yarns 142 and one machine direction yarn 145 in fabric 144 and over the one machine direction yarn 142.

The fabric of the present invention is superior to known papermakers' fabric in that it has a papermaking surface that is coplanar and bicrimped. Instead of long machine direction floats commonly found in the so-called X-Weave fabric, as illustrated in U.S. Pat. No. 4,423,755 to Thomson, the fabric of the present invention has relatively short machine direction floats on its papermaking surface, and accordingly, has less of a tendency to mark the paper formed. In addition, the fabric of the present invention is still open enough to provide good drainage.

The following example is intended to further describe the fabric of the present invention but is not intended to limit the invention:

EXAMPLE

There is provided a quantity of 0.16 mm diameter high density 76/inch polyester monofilament for machine direction yarns and a quantity of 0.23 mm diameter low density 40/inch polyester monofilament yarns for cross machine direction yarns. These yarns are woven together to form a single layer fabric in a 1×1 weave having single float machine direction knuckles alternating on adjacent cross machine direction yarns on its top surface. This fabric will be the upper fabric.

There is also provided a quantity of 0.21 mm diameter high density 76/inch polyester monofilament for machine direction yarns and a quantity of 0.23 mm low density 40/inch polyester monofilament for cross machine direction yarns. These yarns are woven together to form a 1×3 single layer weave.

The two fabrics are joined to form a triple layer papermakers' fabric by two additional sets of cross machine direction yarns, additional fiber supporting yarns and locator yarns, both low tenacity 40/inch polyester monofilament of 0.11 mm diameter. The fiber supporting yarns travel over seven machine direction yarns on the top surface of the upper fabric and under one machine direction yarn. The locator and binder yarn is woven into the joined fabrics in a pattern opposite to that of the fiber supporting yarns, travel under seven machine direction yarns of the top fabric and one machine direction yarn in the lower fabric and over one machine direction yarn.

The embodiments which have been described herein are but some of the several which utilize this invention and are set forth here by way of the illustration but not of limitation. It is apparent that many other embodiments which will be readily apparent that are skilled in the art may be made without departing materially from the spirit and scope of this invention.

What is claimed is:

1. A papermakers' fabric comprising:

a fabric layer including at least one set of cross machine direction yarns and at least one set of machine direction yarns interwoven to form a papermaking surface and a machine contacting surface wherein the machine direction yarns are interwoven to form alternating single knuckles on the paper contacting surface;

additional fiber supporting cross machine direction yarns positioned between adjacent cross machine direction yarns on the papermaking surface of the fabric layer; and additional cross machine direction locator yarns positioned between adjacent cross machine direction yarns on the papermaking surface of the fabric layer, wherein the additional fiber supporting cross machine direction yarns and the additional cross machine direction locator yarns are interwoven with the fabric layer in opposite weave patterns.

2. A papermakers' fabric of claim 1 wherein said additional fiber supporting cross machine direction yarns and said additional cross machine direction locator yarns are of smaller diameter than the yarns of the fabric layer.

3. A papermakers' fabric of claim 2 wherein said additional fiber supporting cross machine direction yarns and said additional cross machine direction locator yarns are one half the size in diameter of the yarns of the fabric layer.

4. A papermakers' fabric of claim 1 wherein for each cross machine direction yarn of the papermaking surface of the fabric layer, there is one additional fiber supporting cross machine direction yarn and one additional cross machine direction locator yarn.

5. A papermakers' fabric of claim 1 wherein said additional fiber supporting cross machine direction yarns are interwoven with the papermaking surface of the fabric layer by passing over at least three adjacent machine direction yarns and under the next adjacent machine direction yarn in a repeating pattern.

6. A papermakers' fabric of claim 5 wherein the additional fiber supporting cross machine direction yarns passes over an odd number of adjacent machine direction yarns, said number being three or more.

7. A papermakers' fabric including at least one set of machine direction yarns and at least one set of cross machine direction yarn interwoven to form a fabric layer having a paper contacting surface and a machine contacting surface, further comprising:

a set of fiber supporting cross machine direction yarns;

a set of cross machine direction locator yarns wherein the fiber supporting yarns are woven into the paper contacting surface in a repeating pattern of long floats followed by an intersection of the fiber supporting yarn with one machine direction yarn of the paper contacting surface;

wherein the locator yarn is woven in a repeating pattern opposite to that of the fiber supporting yarns so that it travels on the papermaking surface only on the machine direction yarn under which the fiber supporting yarn travels, forming an end point; and wherein the machine direction yarn knuckles on the cross machine direction yarns of the papermaking surface adjacent the fiber supporting cross machine direction yarns and the cross machine direction locator yarns define a triangle with the end point in its center.

8. A papermakers' fabric of claim 7 wherein said additional fiber supporting cross machine direction yarns and said additional cross machine direction locator yarns are of smaller diameter than the yarns of the fabric layer.

9. A papermakers' fabric of claim 8 wherein said additional fiber supporting cross machine direction yarns and said additional cross machine direction locator yarns are one half the size in diameter of the yarns of the fabric layer.

10. A papermakers' fabric of claim 7 wherein for each cross machine direction yarn of the papermaking surface of the fabric layer, there is one additional fiber supporting cross machine direction yarns and one additional cross machine direction locator yarns.

11. A papermakers' fabric of claim 7 wherein said additional fiber supporting cross machine direction yarns are interwoven with the papermaking surface of the fabric layer by passing over at least three adjacent machine direction yarns and under the next adjacent machine direction yarn in a repeating pattern.

12. A papermakers' fabric of claim 11 wherein the additional fiber supporting cross machine direction yarns passes over an odd number of adjacent machine direction yarns, said number being three or more.

13. A triple layer papermakers' fabric including at least two sets of machine direction yarns and at least two sets of cross machine direction yarns woven to form two distinctly different fabrics, one being the paper contacting fabric having a paper contacting surface and a bottom surface, the other being the machine contacting fabric, having a top surface and a machine contacting surface, further comprising:

a set of fiber supporting cross machine direction yarns in the paper contacting surface of the paper contacting fabric;

a set of cross machine direction locator/binder yarns;

wherein the fiber supporting yarns are woven into the paper contacting surface in a repeating pattern of long floats followed by an intersection of each of said fiber supporting yarns with one machine direction yarns of the paper contacting surface;

wherein each of said locator/binder yarns is woven in a repeating pattern so that it travels on the papermaking surface only on the machine direction yarn under which the fiber supporting yarn travels, forming an end point, and further traveling to the machine contacting surface on a machine direction yarn in the machine contacting fabric to hold the two fabrics together as a triple layer papermakers' fabric.

* * * * *

UNITED STATES PATENT AND TRADEMARK OFFICE

CERTIFICATE OF CORRECTION

PATENT NO. : 4,987,929

DATED : January 29, 1991

INVENTOR(S) : Robert G. Wilson

It is certified that error appears in the above-identified patent and that said Letters Patent is hereby corrected as shown below:

Column 2, line 56: insert

It is, therefore, an object of the present invention to provide a papermakers' fabric with a superior fiber supporting surface while maintaining a durable wear resistant machine contacting side to the fabric.

Another object of the present invention is to provide a papermakers' fabric in which a significant number of the paper fibers supporting yarns are fine and of a reduced diameter so that high quality support can be provided on the papermaking surface, yet the openness of the paper contacting surface remains high for good drainage.

Another object of the present invention is to provide a papermakers' fabric having a co-planar surface i.e., all machine direction and cross machine direction knuckles or floats are at the same planar height on the fiber supporting surface.

A further object of the present invention is to provide a papermakers' fabric having a predominance of cross machine direction support floats on the papermaking surface, with no machine direction support yarn knuckle being greater than a single float.

UNITED STATES PATENT AND TRADEMARK OFFICE

CERTIFICATE OF CORRECTION

PATENT NO. : 4,987,929

DATED : January 29, 1991

INVENTOR(S) : Robert G. Wilson

It is certified that error appears in the above-identified patent and that said Letters Patent is hereby corrected as shown below:

conti-

Another object of the present invention is to provide a papermakers' fabric having a fiber supporting surface with two distinctly different planar heights in the cross machine direction fabric yarns of the paper fiber supporting surface for controlled alignment of the paper fibers in the forming web.

Yet another object of the present invention is to provide a papermakers' fabric with excellent stability and wear resistance while not compromising the desirable papermaking characteristics of the sheet side of fabric.

Signed and Sealed this

Thirtieth Day of June, 1992

*Attest:*

DOUGLAS B. COMER

*Attesting Officer* *Acting Commissioner of Patents and Trademarks*